US010170039B2

(12) United States Patent
Ishida

(10) Patent No.: US 10,170,039 B2
(45) Date of Patent: Jan. 1, 2019

(54) METHOD FOR CORRECTING DISPLAY DEVICE AND CORRECTION DEVICE FOR DISPLAY DEVICE

(71) Applicant: JOLED INC., Tokyo (JP)

(72) Inventor: Kazuyuki Ishida, Osaka (JP)

(73) Assignee: JOLED INC., Tokyo (JP)

( * ) Notice: Subject to any disclaimer, the term of this patent is extended or adjusted under 35 U.S.C. 154(b) by 96 days.

(21) Appl. No.: 15/501,934

(22) PCT Filed: Jul. 31, 2015

(86) PCT No.: PCT/JP2015/003886
§ 371 (c)(1),
(2) Date: Feb. 6, 2017

(87) PCT Pub. No.: WO2016/021172
PCT Pub. Date: Feb. 11, 2016

(65) Prior Publication Data

US 2017/0229066 A1 Aug. 10, 2017

(30) Foreign Application Priority Data

Aug. 8, 2014 (JP) ..... 2014-163024

(51) Int. Cl.
*G09G 3/3233* (2016.01)

(52) U.S. Cl.
CPC ... *G09G 3/3233* (2013.01); *G09G 2300/0809* (2013.01); *G09G 2310/08* (2013.01);
(Continued)

(58) Field of Classification Search
CPC ..... G09G 3/3233; G09G 2300/0809; G09G 2310/08; G09G 2320/048;
(Continued)

(56) References Cited

U.S. PATENT DOCUMENTS 8,836,691 B2 * 9/2014 Ryu ..... G09G 3/3233 345/214
2003/0201727 A1 * 10/2003 Yamazaki ..... G09G 3/006 315/169.1

(Continued)

FOREIGN PATENT DOCUMENTS

JP 2004-145257 5/2004
JP 2006-030429 2/2006

(Continued)

OTHER PUBLICATIONS

U.S. Appl. No. 15/507,394 to Kazuki Sawa et al., filed Feb. 28, 2017.

(Continued)

*Primary Examiner* — Vinh T Lam
(74) *Attorney, Agent, or Firm* — Greenblum & Bernstein, P.L.C.

(57) ABSTRACT

A method for correcting an organic EL display including a volatile memory (MV), a non-volatile memory having a slower write speed than that of the volatile memory, and a control unit, the method to be performed by the control unit includes: performing cumulative processing for updating cumulative values in the volatile memory every first period; performing transfer processing for transferring the cumulative values from the volatile memory to the non-volatile memory every second period longer than the first period; delaying timing of the transfer processing in part of the display pixels according to the write speed of the second memory; and delaying start timing of the cumulative processing in the part of the display pixels according to the timing of the transfer processing, or switching an order of transfer of the cumulative values in the transfer processing between a first order and the reverse order of the first order.

9 Claims, 12 Drawing Sheets

(52) U.S. Cl.
CPC ..... *G09G 2320/0233* (2013.01); *G09G 2320/0285* (2013.01); *G09G 2320/0295* (2013.01); *G09G 2320/048* (2013.01); *G09G 2320/0693* (2013.01)

(58) Field of Classification Search
CPC ... G09G 2320/0295; G09G 2320/0693; G09G 2320/0285; G09G 2320/0233
See application file for complete search history.

(56) References Cited

U.S. PATENT DOCUMENTS

| | | | |
|---|---|---|---|
| 2005/0156831 | A1 | 7/2005 | Yamazaki et al. |
| 2006/0011846 | A1 | 1/2006 | Ozaki |
| 2007/0146385 | A1 | 6/2007 | Kienhoefer |
| 2008/0252567 | A1 | 10/2008 | Kawabe |
| 2009/0081816 | A1 | 3/2009 | Yamazaki et al. |
| 2011/0075038 | A1 | 3/2011 | Yamazaki et al. |
| 2012/0120126 | A1 | 5/2012 | Yamazaki et al. |
| 2012/0299987 | A1 | 11/2012 | Yamazaki et al. |
| 2013/0293597 | A1* | 11/2013 | Mori ..... G09G 3/007 345/690 |
| 2014/0361959 | A1* | 12/2014 | Yamazaki ..... G09G 3/20 345/76 |

FOREIGN PATENT DOCUMENTS

| | | |
|---|---|---|
| JP | 2007-086347 | 4/2007 |
| JP | 2007-512555 | 5/2007 |

OTHER PUBLICATIONS

International Search Report (ISR) from International Searching Authority (Japan Patent Office) in International Pat. Appl. No. PCT/JP2015/003886, dated Oct. 27, 2015.

* cited by examiner

METHOD FOR CORRECTING DISPLAY DEVICE AND CORRECTION DEVICE FOR DISPLAY DEVICE

TECHNICAL FIELD

The present disclosure relates to a correction method to be performed in a display device and a correction device for a display device.

BACKGROUND ART

In recent years, attention is being given to an organic EL display utilizing organic EL (Electro Luminescence) as one of next generation flat-panel displays that replace liquid crystal displays.

An organic EL display includes an organic EL panel in which a plurality of display pixels are disposed in a matrix form. Each display pixel has an organic EL element and a drive transistor that supplies a drive current according to a pixel signal to the organic EL element.

In an active matrix type display device such as an organic EL display, a thin film transistor (TFT) is used as a drive transistor. In a TFT, a threshold value voltage of the TFT shifts over time due to stress such as a voltage between the gate and source when energized. The shift of a threshold value voltage over time causes a variation in the amount of current supplied to the organic EL, and thus has an effect on brightness control of the display device, and the display quality is reduced.

In addition, in an organic EL element, due to stress of a current that flows through the organic EL element, the brightness decreases over time even with the same amount of current supplied. The decrease in the brightness over time causes the display quality to deteriorate.

In an organic EL display, in order to prevent deterioration of the display quality, a cumulative value of stress (hereinafter briefly called a "cumulative value" as needed) for each of the organic EL element and the TFT is determined, and the gradation values in a video signal are corrected using the cumulative value.

CITATION LIST

Patent Literature

[PTL 1] Japanese Unexamined Patent Application Publication No. 2004-145257

SUMMARY OF INVENTION

Technical Problem

In order to prevent deterioration of the display quality due to stress, a cumulative value of stress used for correction of the gradation values in a video signal needs to be determined with high accuracy. The cumulative value of stress corresponds to a cumulative value of a pixel signal.

However, in a conventional display device, there is a problem in that the accuracy of the cumulative value of a pixel signal is not sufficient.

The present disclosure provides a method for correcting a display device and a correction device for a display device that are capable of improving the accuracy of the cumulative value of a pixel signal.

Solution to Problem

A method for correcting a display device in the present disclosure provides a method for correcting a display device including: a display panel having display pixels, a first memory that stores cumulative values of pixel signals included in a video signal, a second memory having a slower write speed than a write speed of the first memory, and a control unit that controls display of the display panel, the method to be performed by the control unit, comprising: performing cumulative processing for calculating the cumulative values repeatedly in every first period and storing the cumulative values in the first memory in every the first period; performing transfer processing for transferring the cumulative values from the first memory to the second memory in every second period longer than the first period; delaying timing of the transfer processing in one part of the display pixels from timing of the transfer processing in the other part of the display pixels according to the write speed of the second memory; for each of the display pixels, reading a cumulative value from the first memory and correcting a corresponding pixel signal; and delaying start timing of the cumulative processing in the one part of the display pixels according to the timing of the transfer processing.

A method for correcting a display device in the present disclosure provides a method for correcting a display device including: a display panel having display pixels, a first memory that stores cumulative values of pixel signals included in a video signal, a second memory having a slower write speed than a write speed of the first memory, and a control unit that controls display of the display panel, the method to be performed by the control unit, comprising: performing cumulative processing for calculating the cumulative values repeatedly in every first period and storing the cumulative values in the first memory in every the first period; performing transfer processing for transferring the cumulative values from the first memory to the second memory in every second period longer than the first period; delaying timing of the transfer processing in one part of the display pixels from timing of the transfer processing in the other part of the display pixels according to the write speed of the second memory; for each of the display pixels, reading a cumulative value from the first memory and correcting a corresponding pixel signal; and switching an order of transfer of the cumulative values in the transfer processing between a predetermined first order and a second order which is a reverse order of the first order, at timing when an initial value of the first memory is set using a value of the second memory.

Advantageous Effects of Invention

According to the method for correcting a display device in the present disclosure, the accuracy of a cumulative value of a pixel signal can be improved.

DESCRIPTION OF EMBODIMENTS

[Details of Problem]

Figure 1:
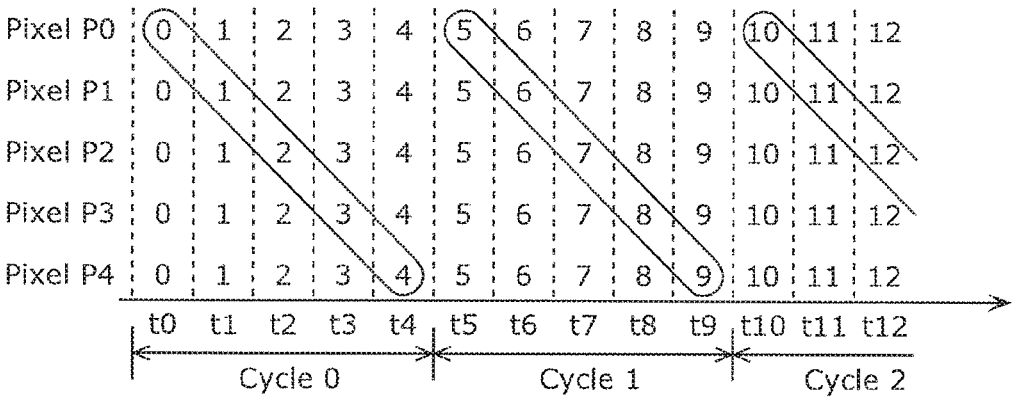
FIG. 1 is a chart illustrating the cumulative values of stress in time series in a volatile memory.

An organic EL display is configured to include an organic EL panel, a data line drive circuit, a scanning line drive circuit, a control unit, and a memory.

The organic EL panel includes a plurality of display pixels disposed in a matrix form, and a plurality of scanning lines and a plurality of data lines connected to the display pixels. Each display pixel includes an organic EL element OEL that emits light according to a drive current, a selection transistor that switches between selection and non-selection of a display pixel according to a voltage of a scanning line, a drive transistor T2 that supplies a drive current according to a voltage of a data line to the organic EL element OEL, and a capacitor C1 that holds a charge according to a voltage of a data line. The drive transistor and the selection transistor are each comprised of a TFT.

The data line drive circuit supplies to the plurality of data lines a voltage according to a correction signal outputted from the control unit.

The scanning line drive circuit supplies to the plurality of scanning lines a voltage according to a drive signal outputted from the control unit.

The control unit controls display of the organic EL display according to information outputted from a remote control or the like. In addition, control unit generates a correction signal by making corrections for improving the display quality on a gradation value included in an externally inputted video signal. The corrections for improving the display quality include, for instance, correction according to a cumulative value of a pixel signal. Also, here, the video signal is a signal for displaying an image constituted by a frame on an organic EL panel 11. The control unit outputs a correction signal to the data line drive circuit. In addition, the control unit generates a drive signal according to a video signal, and outputs the drive signal to the scanning line drive circuit.

The memory includes a volatile memory with a relatively high write speed and a non-volatile memory with a relatively low write speed.

As described above, decrease in the brightness of the organic EL element over time due to stress, and shift of a threshold value voltage in the drive transistor over time due to stress reduce the display quality of the organic EL display. Thus, in the organic EL display, in order to prevent deterioration of the display quality due to stress, stress correction using a cumulative value of stress, that is, a cumulative value of a pixel signal is made on the gradation values in a video signal.

Hereinafter, a method to calculating a cumulative value of stress in an organic EL display will be briefly described.

Calculation of a cumulative value is successively performed, when a video signal is inputted. The control unit reads a current cumulative value in a target display pixel to be processed from the volatile memory. The control unit extracts a gradation value of a target display pixel to be processed from the inputted video signal. The control unit calculates a stress value according to the gradation value. The stress value is a value that is determined according to the cumulative value of stress and the gradation value at the present, and serial processing is necessary. The control unit overwrites the volatile memory with a new cumulative value which is a value obtained by adding a stress value to a cumulative value read from the volatile memory.

As described above, the cumulative value is rewritten each time a stress value is calculated. For this reason, a sufficient write speed is needed for a memory that stores cumulative values. A non-volatile memory has a relatively low write speed, thus is not suitable for the application of rewriting the cumulative value in real time each time a stress value is calculated. For instance, depending on the number of display pixels of the organic EL display, it takes several to ten-odd minutes to write cumulative values for one frame to a flash memory which is an example of a non-volatile memory.

Thus, in general, in order to store a cumulative value in real time, a volatile memory is used. However, since data in a volatile memory is erased when power supply thereto is stopped, the control unit regularly transfers the data in the volatile memory to the non-volatile memory. It is to be noted that the cumulative values transferred to the non-volatile memory are intermittent data because the write speed of the non-volatile memory is low.

However, since the write speed of the non-volatile memory is low, there is a problem in that a difference occurs in the errors in the cumulative values between the plurality of display pixels. The difference between the errors in the cumulative values is accumulated by switching between ON and OFF of a power supply. Hereinafter, the difference between the errors will be described using FIG. 1 to FIG. 4.

Here, for the sake of description, a case will be described in which the same gradation value is set to all the pixels in a video signal. In addition, a case is assumed in which the stress value at each time is 1.

FIG. 1 is a chart illustrating the cumulative values of stress in time series in a volatile memory. In FIG. 1, each time tn (n is an integer greater than or equal to 0) is synchronized with a time when write processing for one frame is performed. At time tn, write processing for the nth frame and cumulative processing for a stress value are performed.

Also, in FIG. 1, for the sake of description, a case is illustrated in which the organic EL panel includes 5 display pixels P0 to P4.

Also, in FIG. 1, transfer timing is set every 5 frames (referred to as "cycle" in FIG. 1). Specifically, the transfer timing for display pixel Pi (i=0 to 4) is set to t (5 k+i) (k is an integer greater than or equal to 0). Not all the cumulative values but the cumulative value stored in the volatile memory at the transfer timing are transferred to the non-volatile memory from the volatile memory. In FIG. 1, the values surrounded by an ellipse are transferred to the non-volatile memory.

Also, in FIG. 1, the cumulative value of stress at time t0 is assumed to be 0. As described above, the same gradation value is set to all the pixels in a video signal, and the stress value at each time is 1. Therefore, the cumulative value is a value that is incremented by 1 at each time.

As illustrated in FIG. 1, in the volatile memory, the cumulative values of stress of all the display pixels P0 to P4 are updated in real time at each time.

On the other hand, the cumulative values which can be transferred to the non-volatile memory are part of the plurality of cumulative values. In FIG. 1, at time t0, the cumulative value of stress at the display pixel P0 is transferred from the volatile memory to the non-volatile memory. At time t1, the cumulative value of stress at the next display pixel P1 is transferred. At time t1, the cumulative value of stress of the display pixel P1 is updated to "1", thus the cumulative value of stress transferred is "1". Similarly, at times t2 to t4, the cumulative values of stress "2" to "4" at the display pixels P2 to P4 are sequentially transferred.

At time t5, returning to the display pixel P0, the cumulative value of stress "5" at the display pixel P0 is transferred from the volatile memory to the non-volatile memory. Similarly, at times t6 to t9, the cumulative values of stress "6" to "9" at the display pixels P1 to P4 are sequentially transferred.

Figure 2:
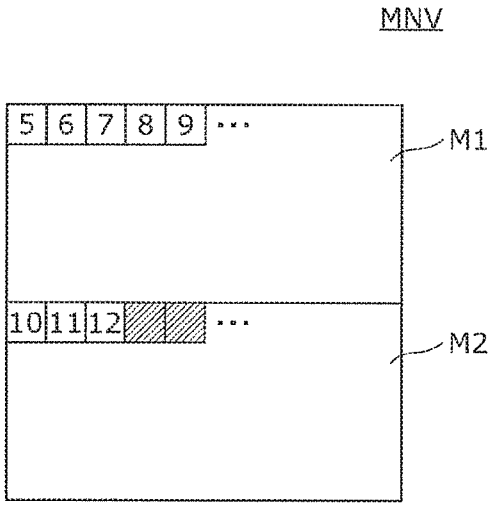
FIG. 2 is a diagram illustrating the state of a non-volatile memory at time t12 of FIG. 1.

FIG. 2 is a diagram illustrating the state of the non-volatile memory at time t12 of FIG. 1. The non-volatile memory MNV includes two areas M1 and M2. The areas M1 and M2 each can store the cumulative values of stress at all the display pixels constituting the organic EL panel. At the point when time t9 is reached, in the area M1, the cumulative values of stress "5" to "9" at the display pixels P0 to P4 at times t5 to t9 (cycle 1) have been written. In the area M2, the cumulative values of stress of the display pixels P0 to P2 at times t10 to t12 (cycle 2) are written. Also, as for the display pixels P3 and P4, the previous cumulative values of stress remain without being updated.

As seen from FIG. 2, the cumulative values of stress stored in the non-volatile memory are values displaced by 1.

Figure 3:
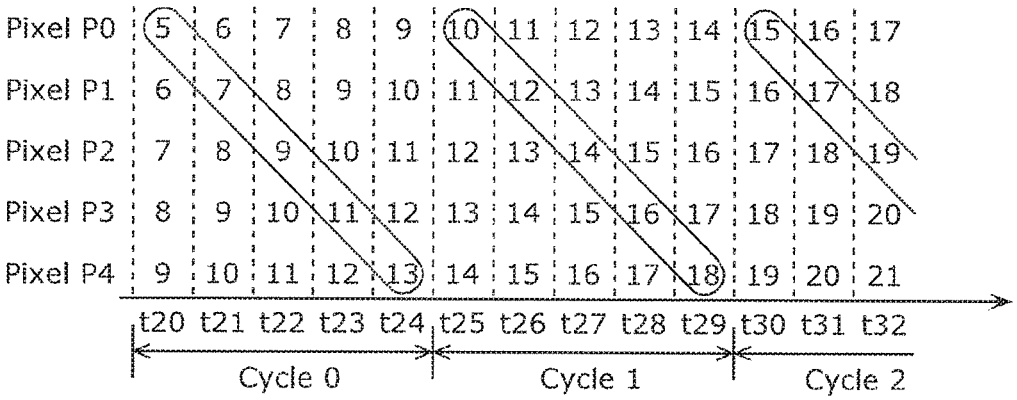
FIG. 3 is a chart illustrating the cumulative values of stress in time series in a volatile memory.
Figure 4:
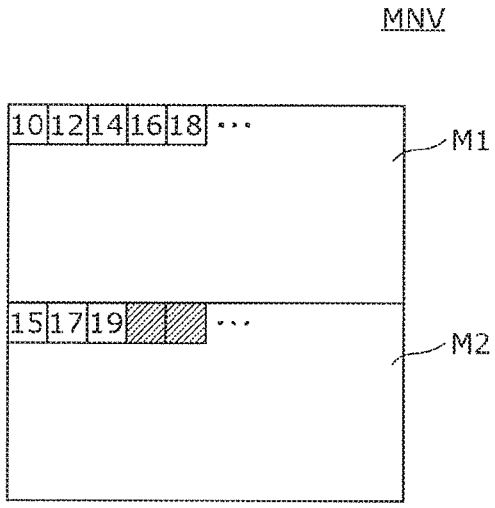
FIG. 4 is a diagram illustrating the state of the non-volatile memory at time t32 of FIG. 3.

FIG. 3 is a chart illustrating the cumulative values of stress in time series in the volatile memory. FIG. 4 is a diagram illustrating the state of the non-volatile memory at time t32 of FIG. 3. FIG. 3 illustrates the state of the volatile memory in time series at time t20 when the power supply is set to ON again, and later time after the power supply is set to OFF at time t12 of FIG. 1.

When the power supply of the organic EL display is set to OFF at time t12 of FIG. 1, the state of the non-volatile memory MNV is maintained at the state illustrated in FIG. 2.

Subsequently, when the power supply of the organic EL display is set to ON, as the initial values of the cumulative value stress, the control unit loads the values stored in the non-volatile memory MNV to the volatile memory. It is to be noted that in FIG. 2, the data in the area M2 is incomplete, thus the values in the area M1 are loaded to the volatile memory.

As seen from FIG. 3, the initial values of the cumulative values of the display pixels P0 to P4 in the volatile memory are "5" to "9" '.

FIG. 4 is a diagram illustrating the state of the non-volatile memory at time t32 of FIG. 3. When the cumulative values in the volatile memory are updated by the same steps as performed at times t0 to t12 illustrated in FIG. 1 and transferred to the non-volatile memory, the cumulative values stored in the area M1 are "10", "12", "14", "16", "18" as illustrated in FIG. 4.

Here, as described above, in the case where the same gradation value is set to all the pixels in a video signal, theoretically, the cumulative values are expected to have the same value at all the times. However, the timing of updating the cumulative values in the volatile memory is off from the timing of transferring the cumulative values from the volatile memory to the non-volatile memory, and thus a difference occurs between the errors included in the cumulative values stored in the non-volatile memory. From the comparison between FIG. 2 and FIG. 4, it is seen that each time ON and OFF of the power supply is repeated, the difference between the errors in the cumulative values is increased.

Like this, in the calculation of cumulative values of stress in a conventional organic EL display, there is a problem in that a difference occurs in the errors in the cumulative values because the timing of updating the cumulative values in the volatile memory is off from the timing of transferring the cumulative values from the volatile memory to the non-volatile memory.

As a method for preventing an error in the cumulative values, it is possible to provide a memory buffer for writing, comprised of a volatile memory. The data stored in the volatile memory is regularly transferred to the memory buffer, and the data stored in the memory buffer is moved to the non-volatile memory. In this case, the memory buffer stores the data at the first time in each cycle, such as the time t0, t5, t10 of FIG. 1, for instance. That is, the data stored in the memory buffer has the same error in the cumulative values. With this configuration, no difference occurs between the errors in the cumulative values in the non-volatile memory.

However, when a memory buffer is newly provided, there arise a problem of an increased number of parts and a problem of an increased manufacturing cost.

Hereinafter, an embodiment will be described in detail with reference to the drawings as needed. However, a detailed description more than necessary may be omitted. For instance, a detailed description of already well-known matters and a redundant description of substantially the same configuration may be omitted. This is for avoiding unnecessarily redundant description below and for facilitating the understanding by those skilled in the art.

It is to be noted that the inventor provides the accompanying drawings and the following description to allow those skilled in the art to understand the present disclosure sufficiently, and these are not intended to limit the subject matter recited in the claims.

Embodiment 1

Hereinafter, Embodiment 1 will be described using FIG. 5 to FIG. 13.

[1-1. Configuration]

In this embodiment, a case will be described in which the display device is an organic EL display.

Figure 5:
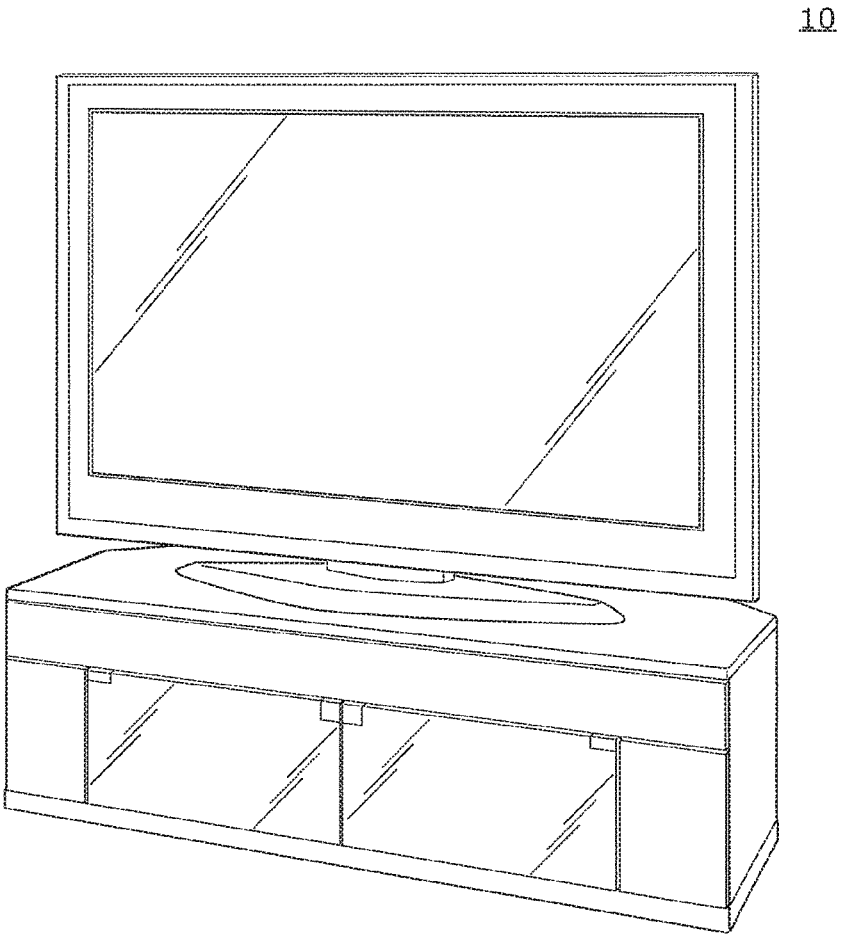
FIG. 5 is an external view illustrating the external appearance of an organic EL display in Embodiment 1.
Figure 6:
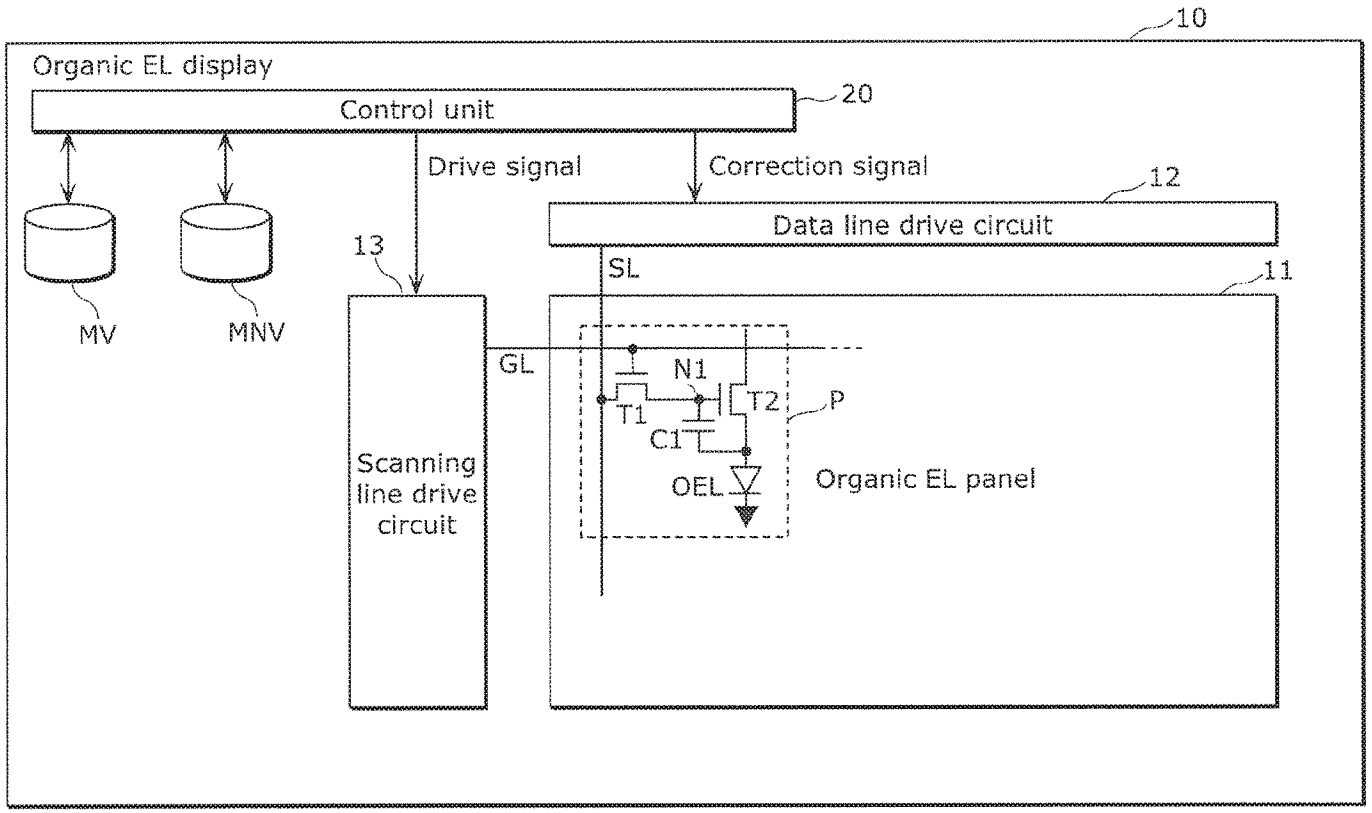
FIG. 6 is a block diagram illustrating an example of the configuration of the organic EL display in Embodiment 1.

FIG. 5 is an external view illustrating the external appearance of an organic EL display 10 in this embodiment. FIG. 6 is a block diagram illustrating an example of the configuration of the organic EL display 10 in this embodiment.

As illustrated in FIG. 6, the organic EL display 10 includes an organic EL panel 11, a data line drive circuit 12, a scanning line drive circuit 13, a control unit 20, a volatile memory MV, and a non-volatile memory MNV.

[1-1-1. Organic EL Panel and Drive Circuit]

The organic EL panel 11 is an example of a display panel including a plurality of display pixels P disposed in a matrix form, and a plurality of scanning lines GL and a plurality of data lines SL connected to the plurality of display pixels P.

In this embodiment, the display pixels P each include an organic EL element OEL, a selection transistor T1, a drive transistor T2, and a capacitor C1.

The selection transistor T1 switches between selection and non-selection of the display pixel P according to a voltage of a scanning line GL. The selection transistor T1 is a thin film transistor, and the gate terminal, source terminal, and drain terminal are connected to a scanning line GL, a data line SL, and a node N1, respectively.

The drive transistor T2 supplies a drive current according to a voltage of the data line SL to the organic EL element OEL. The drive transistor T2 is a thin film transistor, and the gate terminal and source terminal are connected to the node N1 and the anode electrode of the organic EL element OEL, respectively, and a voltage VTFT is supplied to the drain terminal.

The organic EL element OEL is a light emitting element that emits light according to a drive current. The drive current is supplied from the drive transistor T2. The anode electrode of the organic EL element OEL is connected to the source terminal of the drive transistor T2, and the cathode electrode of the organic EL element OEL is grounded.

The capacitor C1 is a capacitor in which a charge according to a voltage of the data line SL is accumulated, and one end is connected to the node N1 and the other end is connected to the source terminal of the drive transistor T2.

The data line drive circuit 12 supplies a voltage according to a correction signal outputted from the control unit 20 to the plurality of data lines SL.

The scanning line drive circuit 13 supplies a voltage according to a drive signal outputted from the control unit 20 to the plurality of scanning lines GL.

It is to be noted that this embodiment has been described using an example in which the selection transistor T1 and the drive transistor T2 are N-type TFTs, but may be P-type TFTs. Even in this case, the capacitor C1 is connected to between the gate and source of the drive transistor T2.

[1-1-2. Control Unit and Memory]

The control unit 20 is a circuit that controls display of a video in the organic EL panel 11, and is formed by using for, instance, a TCON (timing controller) and the like. It is to be noted that the control unit 20 may be formed using a computer system including a micro controller or a system LSI (Large Scale Integrated circuit).

The control unit 20 performs control of correction processing on an externally inputted video signal, and of write processing of accumulated data for correction. The video signal here is a signal for displaying an image constituted by a frame on the organic EL panel 11. The video signal includes the gradation values of a plurality of pixels included in an image indicated by a video signal. The gradation value is an example of a pixel signal.

Correction of a video signal includes stress correction for preventing the above-described deterioration of the display quality due to stress. The control unit 20 performs stress correction on the gradation values in a video signal to generate a correction signal, and outputs the correction signal to the data line drive circuit 12.

Figure 7:
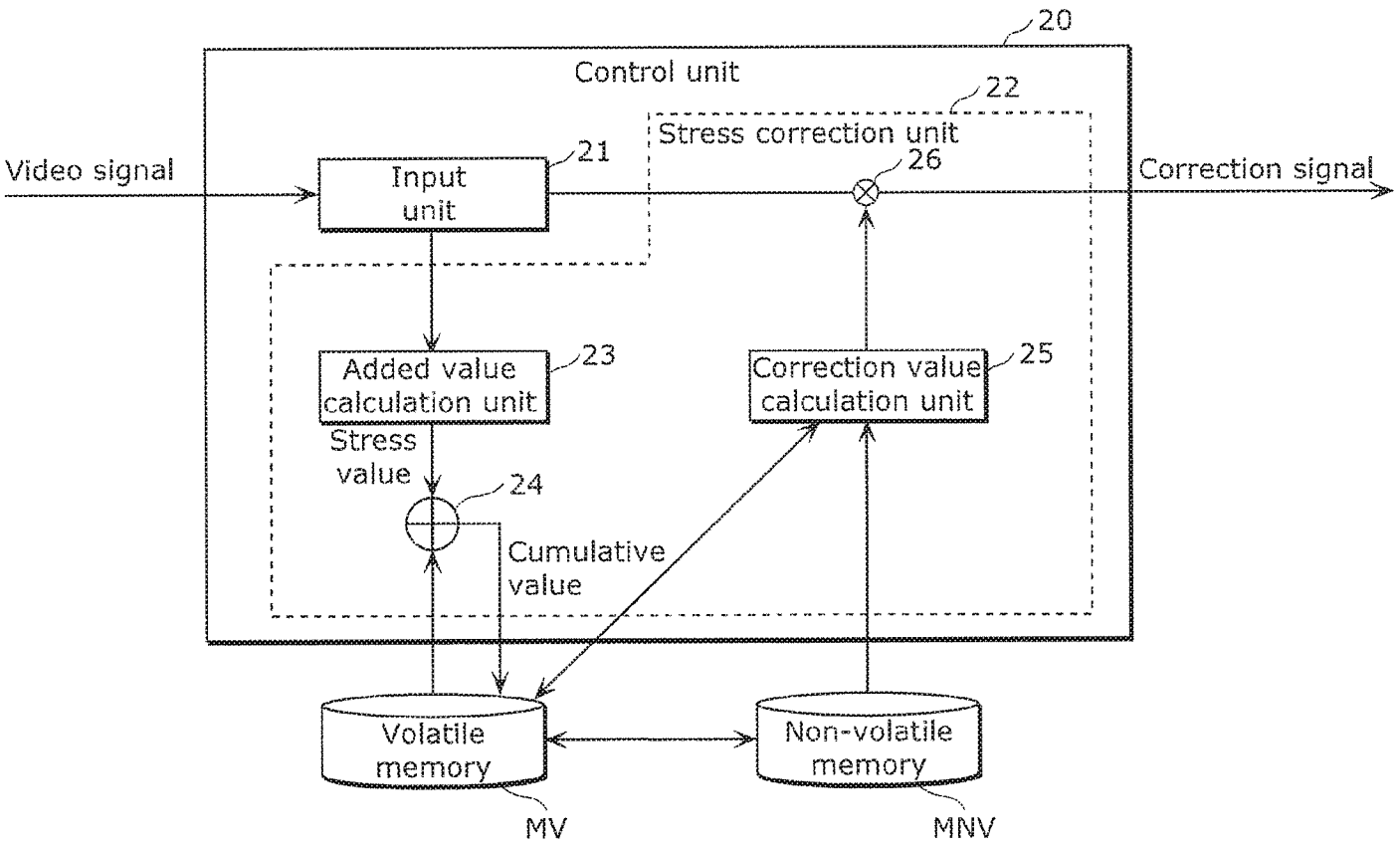
FIG. 7 is a block diagram illustrating an example of the configuration of a control unit in Embodiment 1.

FIG. 7 is a block diagram illustrating an example of the configuration of the control unit 20 in this embodiment. FIG. 7 illustrates part of the components included in the control unit 20, a portion related to stress correction. In addition to the configuration illustrated in FIG. 7, the control unit 20 includes a circuit that generates a drive signal.

As illustrated in FIG. 7, the control unit 20 includes an input unit 21 and a stress correction unit 22.

The input unit 21 receives an externally inputted video signal, and makes adjustment of the size of an image. The input unit 21 sequentially obtains the gradation value of each of the plurality of display pixels P included in the organic EL panel 11, and outputs the gradation value to an added value calculation unit 23 and a multiplication unit 26 of the stress correction unit 22.

The stress correction unit 22 performs stress correction using the cumulative values of stress. As illustrated in FIG. 7, the stress correction unit 22 includes an added value calculation unit 23, an addition unit 24, a correction value calculation unit 25, and a multiplication unit 26.

The added value calculation unit 23 calculates a stress value of each organic EL element OEL included in the display pixels P from the gradation value of a video signal. The stress value of the organic EL element OEL is determined using a function of variables of the current stress value stored in the volatile memory MV, and the gradation value in a video signal.

The addition unit 24 overwrites the volatile memory MV with a new cumulative value which is a value obtained by adding a stress value to a cumulative value stored in the volatile memory MV.

For each of the plurality of display pixels, the correction value calculation unit 25 reads a corresponding cumulative value from the volatile memory MV, and calculates a correction coefficient for correcting a corresponding gradation value. It is to be noted that in this embodiment, before the first cumulative value after start-up is calculated by the added value calculation unit 23 and the addition unit 24, the correction value calculation unit 25 may read a cumulative value not from the volatile memory MV but from the non-volatile memory MNV.

The multiplication unit 26 multiplies a gradation value outputted from the input unit by a correction coefficient, thereby generating a correction signal in which the gradation value is corrected according to the cumulative value of stress.

The control unit 20 performs the above-described write processing per frame.

In this embodiment, the memory includes the volatile memory MV and the non-volatile memory MNV.

The volatile memory MV is an example of a first memory that stores the cumulative value (temporal cumulative value) of each of the plurality of pixel signals included in a video signal. The volatile memory MV stores a stress value as a cumulative value. The volatile memory MV stores a cumulative value temporarily. The volatile memory MV is, for instance, a DRAM (Dynamic Random Access Memory) or a SRAM (Static Random Access Memory).

The non-volatile memory MNV is an example of a second memory that has a lower write speed than that of the first memory. The non-volatile memory MNV is a memory that stores a cumulative value non-temporarily. Herein, a case will be described in which the non-volatile memory MNV is a Flash memory. The non-volatile memory MNV includes two areas M1 and M2 (see FIG. 10). The areas M1 and M2 each can store the cumulative values of stress in all the organic EL elements OEL included in the organic EL panel 11.

[1-2. Operation]

The operation of the control unit 20 of thus configured organic EL display 10 will be described based on FIG. 8 to FIG. 12.

The organic EL display 10 of this embodiment performs stress cumulative processing, and transfer processing as the processing to determine a cumulative value of a pixel signal.

In this embodiment, in order to reduce the error in a cumulative value, start timing of stress cumulative processing in part of the plurality of display pixels is shifted according to the timing of transfer processing. The start timing of stress cumulative processing for the plurality of display pixels is pre-set, and stored in the memory.

[1-2-1. Stress Cumulative Processing]

For each of the organic EL elements OEL, the control unit 20 repeatedly calculates a cumulative value every first period, and performs stress cumulative processing for storing in the volatile memory MV every first period. Herein, the first period is one frame period in which processing for an image in one frame is performed.

The details of stress cumulative processing will be described based on FIG. 8. The stress cumulative processing is performed synchronously with the write processing to the display pixels P.

Figure 8:
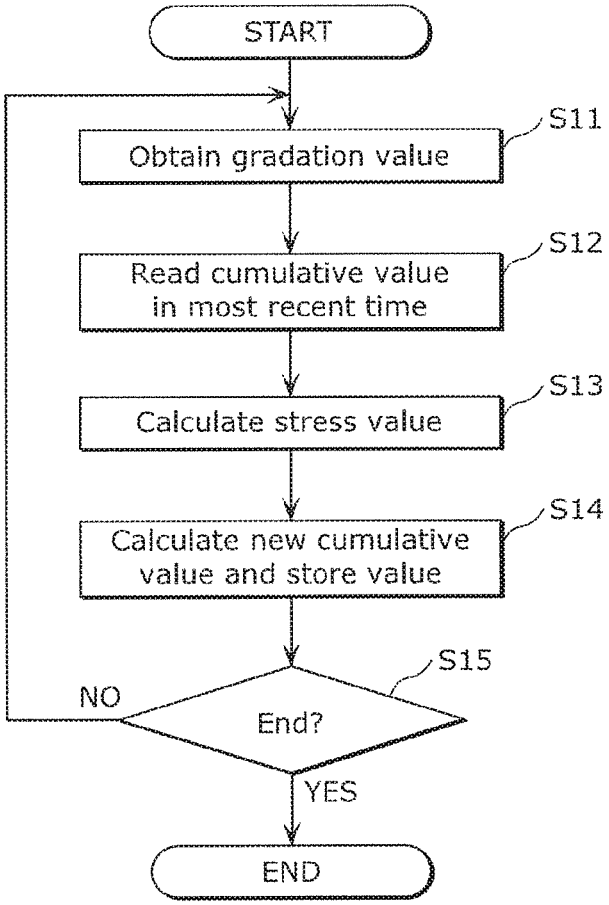
FIG. 8 is a flowchart illustrating an example of the processing steps of stress cumulative processing in Embodiment 1.

FIG. 8 is a flowchart illustrating an example of the processing steps of the stress cumulative processing in this embodiment. FIG. 8 illustrates processing for one frame. The stress cumulative processing illustrated in FIG. 8 is performed for each of the plurality of frames included in a video signal.

When the power supply of the organic EL display 10 is turned on and an external video signal is inputted, the control unit 20 starts the stress cumulative processing.

Upon receiving a video signal, the input unit 21 obtains from the video signal, a gradation value corresponding to a target pixel to be processed out of the plurality of display pixels. The input unit 21 outputs the obtained gradation value to the added value calculation unit 23.

The addition unit 24 reads a cumulative value at the target pixel to be processed from the volatile memory MV (S12).

The added value calculation unit 23 calculates a stress value of the target pixel to be processed according to the gradation value in the video signal corresponding to the target pixel to be processed (S13). More specifically, the added value calculation unit 23 calculates a stress value according to the cumulative value, and the gradation value read in step S12. The stress value is expressed by a time conversion value, for instance, under the assumption that a constant current continues to flow through the organic EL element OEL.

In addition, the addition unit 24 adds the stress value calculated by the added value calculation unit 23 to the read cumulative value. The addition unit 24 stores the value obtained by the addition in the volatile memory MV as a new cumulative value of the target pixel to be processed (S14).

In the control unit 20, when a target display pixel for stress cumulative processing is present (NO in S15), the flow proceeds to step S11, and when a target display pixel for stress cumulative processing is not present (YES in S15), the stress cumulative processing in the frame is completed.

[1-2-2. Transfer Processing]

The control unit 20 performs transfer processing in which the cumulative values stored in the volatile memory MV are transferred to the non-volatile memory MNV every second period longer than the first period. The control unit 20 delays transfer timing for the cumulative values in part of the plurality of display pixels according to the write speed of the non-volatile memory MNV. For part of the display pixels, P1 to P4, the control unit 20 performs transfer processing with shifted (delayed) timing relative to the display pixel P0. The interval of the delay is preferably a multiple of the first period, and shorter than the second period.

Figure 9:
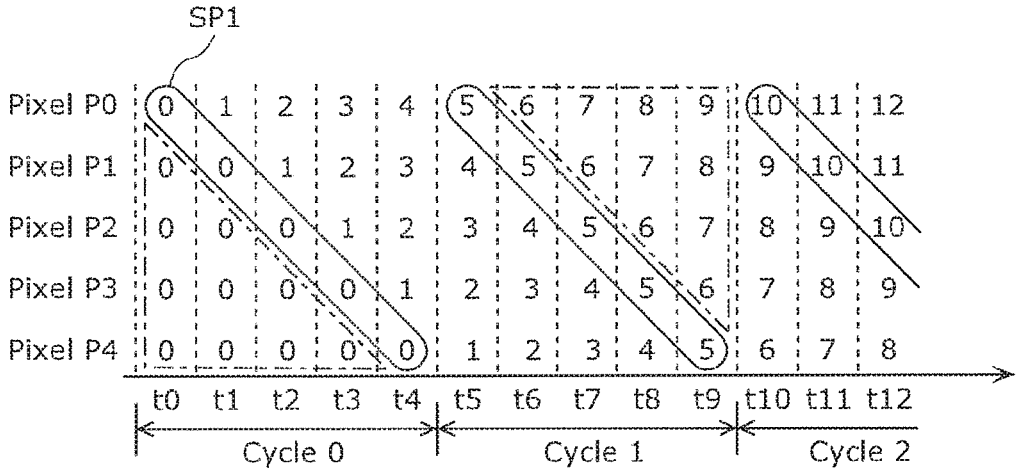
FIG. 9 is a chart illustrating the cumulative values of stress in time series in a volatile memory of Embodiment 1.

FIG. 9 is a chart illustrating the cumulative values of stress in time series in the volatile memory MV of this embodiment. In FIG. 9, each time tn (n is an integer greater than or equal to 0) is synchronized with a time when write processing for one frame is performed. At time tn, nth frame is processed.

Similarly to FIG. 1 and FIG. 3, in FIG. 9, for the sake of description, a case is illustrated in which the organic EL panel includes 5 display pixels P0 to P4.

The transfer timing for the cumulative values of the display pixels P0 to P4 will be described. In FIG. 9, the values surrounded by an ellipse are transferred to the non-volatile memory. In other words, the transfer timing for the cumulative values of display pixels P is the timing for cumulative values surrounded by an ellipse.

When j (j is a natural number) cumulative values can be transferred per frame, and let f be the number of frames needed to transfer all the cumulative values, the transfer timing for the display pixel Pi (i is an integer greater than or equal to 0) is given by $t(i/j+f\times k)$ (k is a natural number). It is to be noted that in the term shown by i/j in the expression, a fractional part is truncated.

It is to be noted that in general, a certain number of cumulative values can be transferred to the non-volatile memory MNV at a time although the number depends on the specification of the non-volatile memory MNV. That is, some number of cumulative values according to the specification of the non-volatile memory MNV can be transferred at a time in one frame period. However, the number of transferable cumulative values is considerably smaller than the total number of the display pixels included in the organic EL panel 11. When j cumulative values can be transferred to the non-volatile memory MNV per frame, the plurality of display pixels P are divided into groups with each group including j display pixels P, and cumulative values for one group are transferred at each time tn. In this case, the display pixels P0 to P4 in FIG. 9 correspond to representative pixels of the pixel groups G0 to G4.

In the example illustrated in FIG. 9, the transfer timing for the cumulative value of the display pixel Pi is $t(i+5\ k)$.

The display pixels other than the display pixel P0 are delayed by i/j (fractional part is truncated) frames relative to the transfer timing for the display pixel P0.

[1-2-3. Start Timing for Stress Cumulative Processing]

For part of the plurality of display pixels, the control unit 20 delays start timing of stress cumulative processing according to the timing of transfer processing.

The start timing of stress cumulative processing, and the states of the volatile memory MV and the non-volatile memory MNV will be described using FIG. 9 to FIG. 12.

In the example illustrated in FIG. 9, the start timing of cumulative processing for the display pixel Pi (i=0 to 4) is shifted by i frames.

It is to be noted that when j (j is a natural number) cumulative values are transferred per frame, stress cumulative processing for the ith display pixel is delayed by i/j (fractional part is truncated) frames. In FIG. 9, the timing for ellipse SP1 is the start timing of stress cumulative processing. In FIG. 9, the start timing of stress cumulative processing for the display pixel Pi is time ti.

[1-2-4. Effect Due to Delay of Start Timing of Stress Cumulative Processing]

Hereinafter, the effect on the volatile memory MV due to delay of the start timing of stress cumulative processing will be specifically described using FIG. 9 to FIG. 12.

When the time is t0, the added value calculation unit 23 performs stress cumulative processing for the display pixel P0. For the display pixels P1 to P4, stress cumulative processing is not performed because the start timing of stress cumulative processing has not reached. Thus, at time t1, the cumulative value of the display pixel P0 is 1, and the cumulative values of other display pixels P1 to P4 remain to be 0.

Similarly, at time t1 to t4, the addition value calculation unit 23 performs stress cumulative processing for the display pixels P0 to Pn when the time is tn. The stress cumulative processing is not performed for the display pixel P for which the start timing of stress cumulative processing has not reached. Thus, at time tn, the cumulative value of the display pixel P0 is n, the cumulative value of the display pixel P1 is (n−1), the cumulative value of the display pixel P2 is (n−2), the cumulative value of the display pixel P3 is (n−3), and the cumulative value of the display pixel P4 is (n−4). That is, the value of the cumulative value of the display pixel Pi assumes a state in which the value of the cumulative value of the display pixel P(i−1) is shifted to the right by 1.

As seen from FIG. 9, all the numerical values surrounded by an ellipse are the same.

Figure 10:
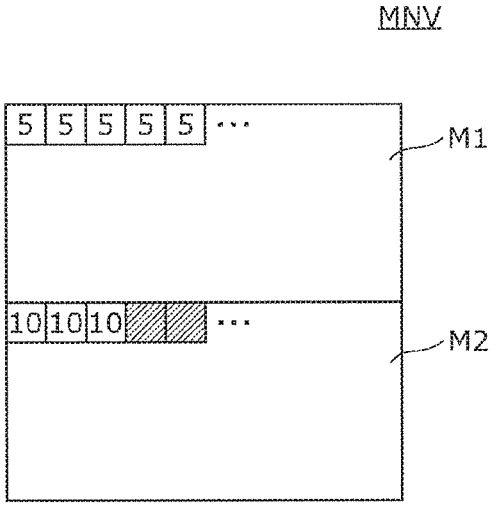
FIG. 10 is a diagram illustrating the state of the non-volatile memory at time t12 of FIG. 9.

FIG. 10 is a diagram illustrating the state of the non-volatile memory at time t12 of FIG. 9. As illustrated in FIG. 10, in the area M1, "5" is stored as the cumulative value of the display pixels P0 to P4. That is, the values of the cumulative values are the same for all the display pixels.

Figure 11:
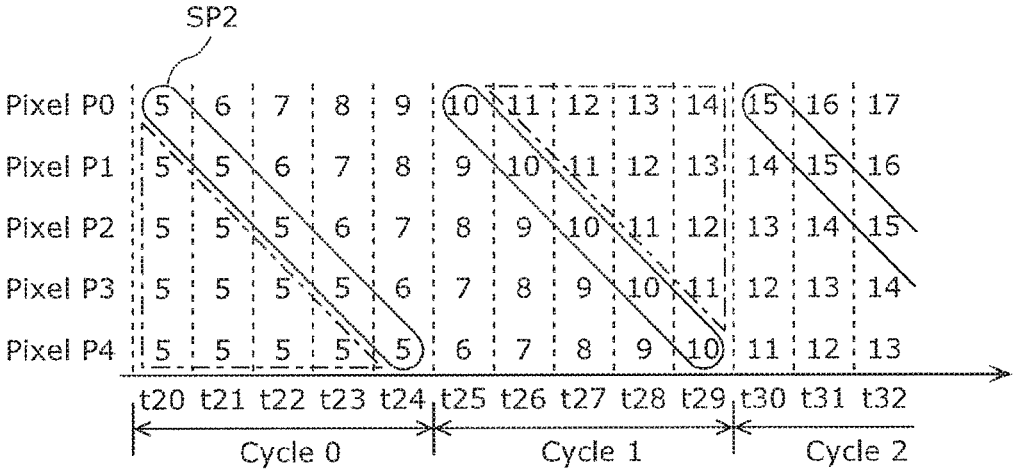
FIG. 11 is a chart illustrating the cumulative values of stress in time series in the volatile memory of Embodiment 1.

FIG. 11 is a chart illustrating the cumulative values of stress in time series in the volatile memory MV of this embodiment. FIG. 11 illustrates the state of the volatile memory in time series at time t20 when the power supply is set to ON again, and later time after the power supply is set to OFF at time t12 of FIG. 9.

Similarly to the case of FIG. 9, also in FIG. 11, the start timing of stress cumulative processing for the ith pixel is shifted for i frames, and the start timing of stress cumulative processing for the display pixel Pi is time ti.

As seen from FIG. 11, all the numerical values surrounded by an ellipse are the same.

Figure 12:
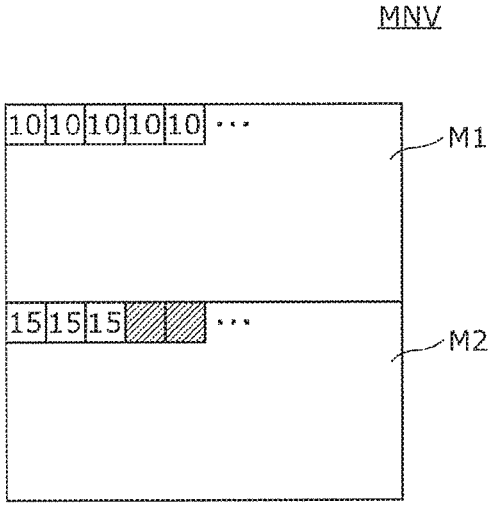
FIG. 12 is a diagram illustrating the state of the non-volatile memory at time t32 of FIG. 11.

FIG. 12 is a diagram illustrating the state of the non-volatile memory at time t32 of FIG. 11. As illustrated in FIG. 12, in the area M1, "10" is stored as the cumulative value of the display pixels P0 to P4. That is, the values of the cumulative values are the same for all the display pixels.

Here, in this embodiment, since a case is assumed in which a video signal with the same gradation value is inputted to all the display pixels, it is expected that the cumulative values are the same at all times. As seen from FIG. 9 to FIG. 12, in this embodiment, the same cumulative value is stored in the non-volatile memory for display pixels expected to have the same cumulative value.

Here, the data in portions surrounded by a dashed dotted line in FIG. 9 and FIG. 11 is practically discarded, and thus the cumulative values stored in the non-volatile memory MNV include an error. However, in the case of this embodiment, the value of an error between the plurality of display pixels is constant. Also, in actual use conditions, switching between ON and OFF of a power supply is not expected to be performed frequently, and thus even with the above-described error included, the accuracy of the cumulative value is sufficient for correcting the gradation value of the video signal.

[1-3. Effect]

As described above, the organic EL display 10 of this embodiment delays start timing of stress cumulative processing according to the write speed of the non-volatile memory MNV, and thus errors in the cumulative values between the plurality of display pixels have a substantially uniform value.

On the other hand, in a conventional organic EL display illustrated in FIGS. 1 to 4, errors in the cumulative values between the plurality of display pixels have different values. For this reason, in a conventional organic EL display, when a pixel signal is corrected using the cumulative value, brightness unevenness may occur.

Figure 13:
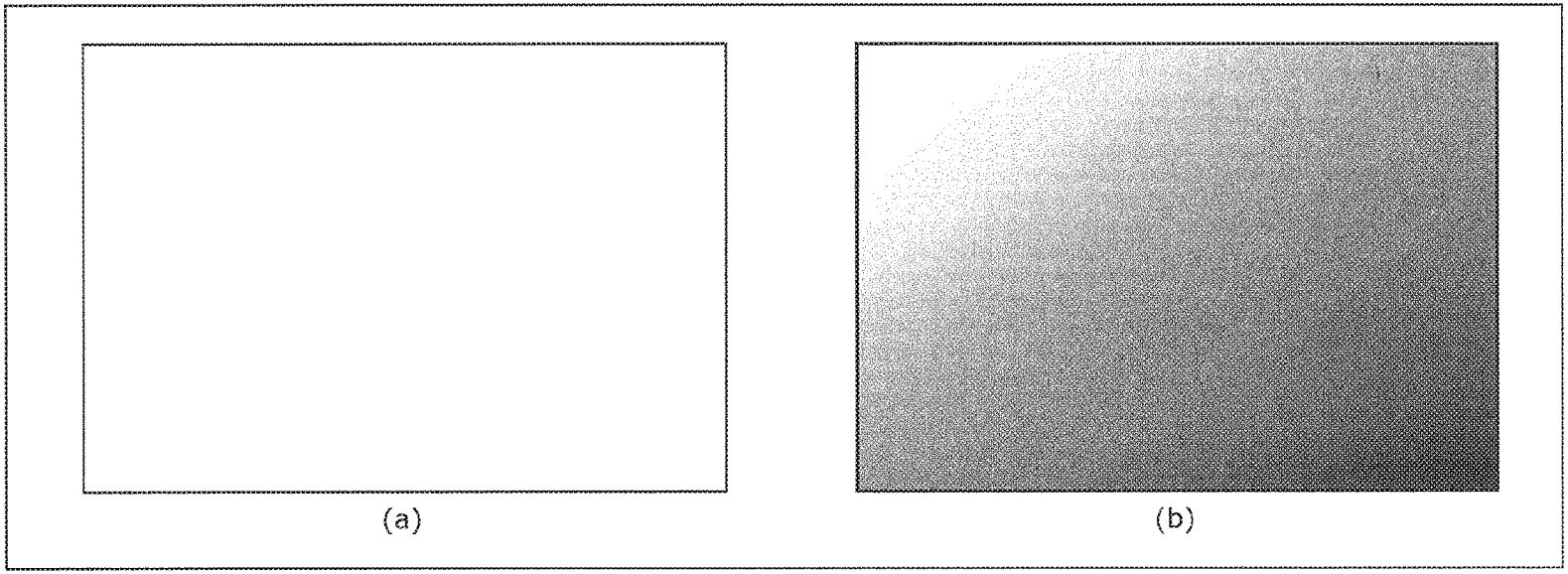
FIG. 13 is a view illustrating a result of making corrections using cumulative values of stress in each of the organic EL display in Embodiment 1 and a conventional organic EL display.

FIG. 13 is a view illustrating a result of making corrections using cumulative values of stress in each of the organic EL display 10 in this embodiment and a conventional organic EL display. In (a) of FIG. 13, a result of correction is illustrated that is made on the organic EL display 10 in this embodiment using the cumulative values of stress. In (b) of FIG. 13, a result of correction is illustrated that is made on a conventional organic EL display using the cumulative values of stress. It can be seen that in (b) of FIG. 13, gradation has occurred in brightness, whereas in (a) of FIG. 13, correction is made uniformly, and the video quality has been improved. It is to be noted that in FIG. 13, an example of the case is illustrated in which pixel signals are sequentially corrected from the upper left pixel to the lower right pixel. When the pixel signals are corrected in another order, although the manner in which brightness unevenness occurs changes, brightness unevenness occurs.

In addition, since other components such as a memory buffer is not added in the organic EL display 10 of this embodiment, increase in manufacturing cost can be reduced.

Embodiment 2

Embodiment 2 will be described using FIG. 14 to FIG. 18.

In Embodiment 1, the start timing of stress cumulative processing for part of the display pixels is delayed according to the write speed of the non-volatile memory. On the other hand, in this embodiment, the order of transfer of the plurality of cumulative values in transfer processing is switched between a predetermined first order and a second order which is the reverse order of the first order, at the timing when the initial values of the volatile memory MV are set using the values of the non-volatile memory MNV. In this embodiment, the timing of switching is when a power supply is turned on.

It is to be noted that similarly to Embodiment 1, in this embodiment, a case will be described in which the display device is an organic EL display. The configuration of the organic EL display of this embodiment is the same as the configuration of the organic EL display 10 illustrated in FIG. 5 to FIG. 7 although the operation of the stress correction unit 22 in the control unit 20 is different.

[2-1. Operation]

The operation of the control unit 20 of the organic EL display 10 in this embodiment will be described based on FIG. 14 to FIG. 18.

Similarly to Embodiment 1, in this embodiment, the processing for calculating a cumulative value of a pixel signal will be described. Similarly to Embodiment 1, the organic EL display 10 of this embodiment performs stress cumulative processing, and transfer processing as the processing to determine a cumulative value of a pixel signal.

It is to be noted that the processing steps of stress cumulative processing are the same as the processing steps of stress cumulative processing of Embodiment 1 illustrated in FIG. 8. However, in this embodiment, the start timing of stress cumulative processing is the same for all the display pixels.

Although the transfer processing is essentially the same as in Embodiment 1, the transfer order is different.

[2-1-1. Switching Between Transfer Orders]

Figure 14:
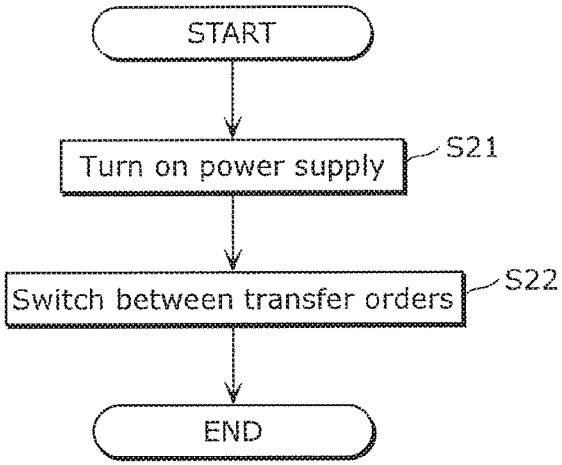
FIG. 14 is a flowchart illustrating the steps of switching between transfer orders in Embodiment 2.

FIG. 14 is a flowchart illustrating the steps of switching between transfer orders in this embodiment. It is to be noted that in this embodiment, it is assumed that the timing when the initial values of the volatile memory MV are set using the values of the non-volatile memory MNV is when a power supply is turned on.

When a power supply is turned on (S21), the control unit 20 switches the transfer order between the first order and the second order which is the reverse order of the first order.

Here, as described in Embodiment 1, when j cumulative values can be transferred per frame, the plurality of display pixels P are divided into groups with each group including j display pixels P, and cumulative values for one group are transferred at each time tn. In this case, the order of transfer is set for each group.

Figure 15:
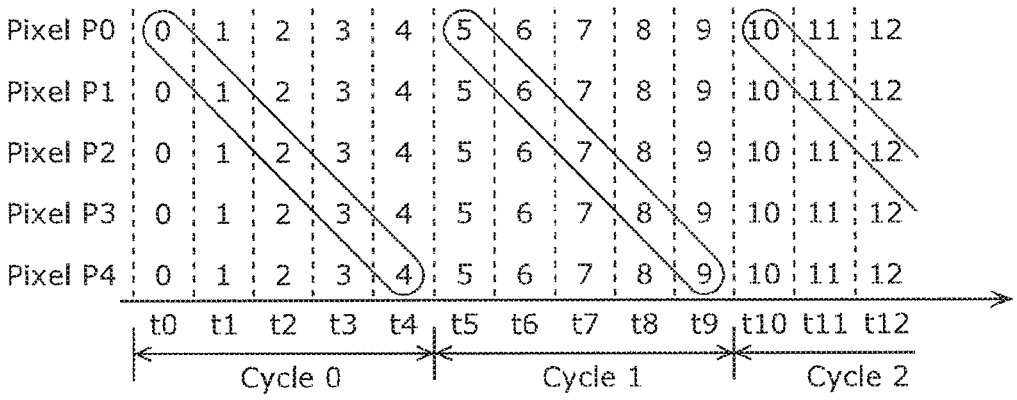
FIG. 15 is a chart illustrating the cumulative values of stress in time series in a volatile memory of Embodiment 2.

FIG. 15 is a chart illustrating the cumulative values of stress in time series in the volatile memory MV of this embodiment. In FIG. 15, each time tn (n is an integer greater than or equal to 0) is synchronized with a time when write processing for one frame is performed. At time tn, nth frame is processed.

Similarly to FIG. 9, in FIG. 15, for the sake of description, a case is illustrated in which the organic EL panel includes 5 display pixels P0 to P4.

The transfer timing and transfer order of the cumulative values of the display pixels P0 to P4 are the same as in Embodiment 1 illustrated in FIG. 9.

In FIG. 15, in the volatile memory, the cumulative values of stress of all the display pixels P0 to P4 are updated in real time at each time tn.

The order of transfer from the volatile memory MV to the non-volatile memory MNV in FIG. 15 is given by the order (corresponding to the first order) of the display pixels P0 to P4.

Figure 16:
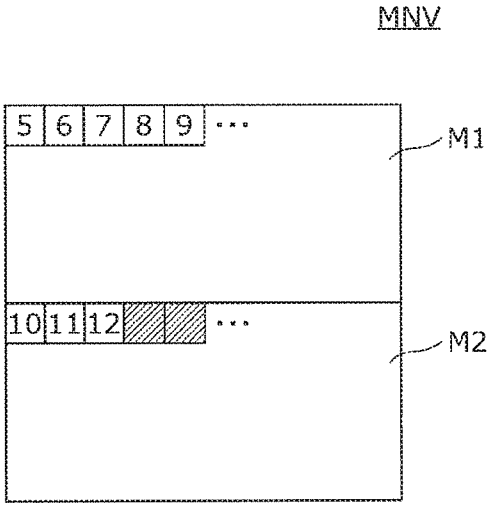
FIG. 16 is a diagram illustrating the state of the non-volatile memory at time t12 of FIG. 15.

FIG. 16 is a diagram illustrating the state of the non-volatile memory at time t12 of FIG. 15. In FIG. 16, in the area M1 of the non-volatile memory MNV, the cumulative values of stress "5" to "9" at the display pixels P0 to P4 at times t5 to t9 (cycle 1) have been written. In the area M2, the cumulative values of stress of the display pixels P0 to P2 at times t10 to t12 (cycle 2) are written. Also, as for the display pixels P3 and P4, the previous cumulative values of stress remain without being updated.

Figure 17:
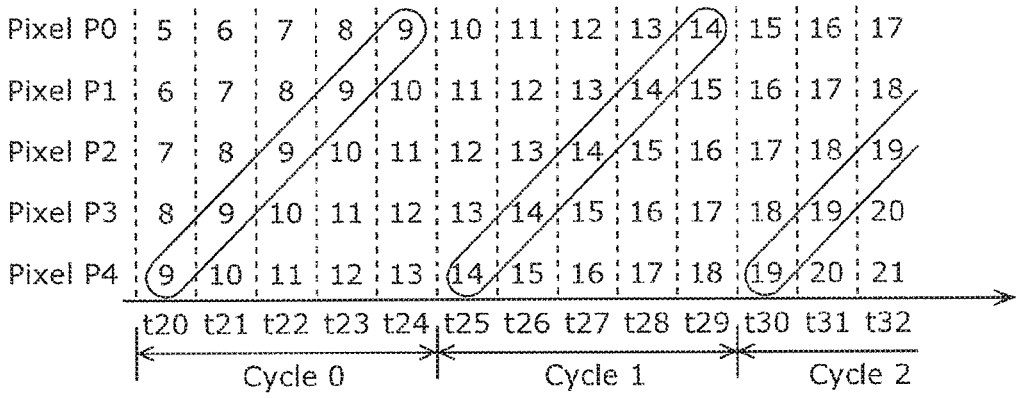
FIG. 17 is a chart illustrating the cumulative values of stress in time series in the volatile memory of Embodiment 2.

FIG. 17 is a chart illustrating the cumulative values of stress in time series in the volatile memory MV of this embodiment. FIG. 17 illustrates the state of the volatile memory in time series at time t20 when the power supply of the organic EL display is set to ON again, and later time after the power supply is set to OFF at time t12 of FIG. 15. At this point, the transfer order is switched from the first order to the second order.

In FIG. 17, the order of transfer from the volatile memory MV to the non-volatile memory MNV is the reverse of the transfer order in FIG. 15, and is given by the order (corresponding to the second order) of the display pixels P4 to P0.

When the power supply of the organic EL display is set to OFF at time t12 of FIG. 15, the state of the non-volatile memory MNV is maintained at the state illustrated in FIG. 16.

Subsequently, when the power supply of the organic EL display is set to ON, as the initial values of the cumulative value stress, the control unit 20 loads the values stored in the non-volatile memory MNV to the volatile memory MV. It is to be noted that in FIG. 16, the data in the area M2 is incomplete, thus the values in the area M1 are loaded to the volatile memory.

As seen from FIG. 17, the initial values of the cumulative values of the display pixels P0 to P4 in the volatile memory are "5" to "9". Also, the control unit 20 increments the cumulative value by 1 at each time tn.

In FIG. 17, the order of transfer of the cumulative values from the volatile memory MV to the non-volatile memory MNV is the order of the display pixels P4 to P0. In FIG. 17, the cumulative values surrounded by an ellipse are the cumulative values to be transferred to the non-volatile memory MNV. As seen from FIG. 17, the cumulative values surrounded by an ellipse have the same value for all the display pixels.

Figure 18:
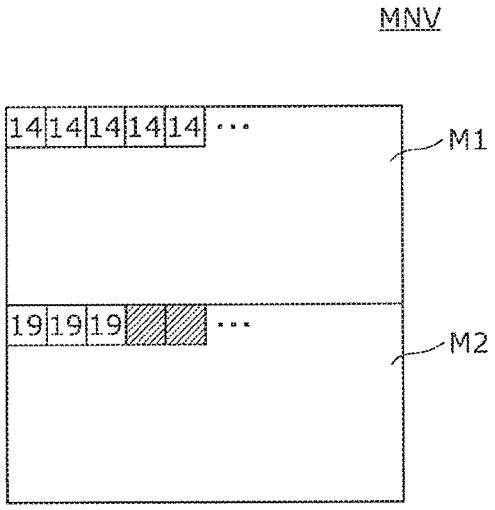
FIG. 18 is a diagram illustrating the state of the non-volatile memory at time t32 of FIG. 17.

FIG. 18 is a diagram illustrating the state of the non-volatile memory at time t32 of FIG. 17. When the cumulative values in the volatile memory are updated by the same steps as performed at times t0 to t12 illustrated in FIG. 15 and transferred to the non-volatile memory MNV, the cumulative values stored in the area M1 are the same "14" for all the display pixels as illustrated in FIG. 18.

[2-2. Effect]

As described above, the organic EL display 10 of this embodiment switches between the predetermined first order and the second order which is the reverse order of the first order, at the timing when the initial values of the volatile memory MV are set using the values of the non-volatile memory MNV. Thus, similarly to the organic EL display 10 of Embodiment 1, in the organic EL display 10 of this embodiment, the errors in the cumulative values between the plurality of display pixels have a substantially uniform value, and thus the display quality can be improved.

In addition, similarly to Embodiment 1, other components such as a memory buffer are not added in the organic EL display 10 of this embodiment, increase in manufacturing cost can be reduced.

Other Embodiments

So far, Embodiments 1 and 2 have been described as the illustrative examples of the technique disclosed in the present application. However, the technique in the present disclosure is not limited to this, and is also applicable to an embodiment in which modification, replacement, addition, omission has been made. In addition, a new embodiment may be implemented by combining the components described in the Embodiments 1 and 2.

(1) Although in the Embodiments 1 and 2, the case has been described in which the technique of the present disclosure is applied to an organic EL display, the present disclosure is not limited to this. The technique may be applied to other display devices such as a plasma display (PDP) or a liquid crystal display.

(2) Although in the Embodiments 1 and 2, cumulative values are calculated and the cumulative values are overwritten in the volatile memory MV per frame, the present disclosure is not limited to this. For instance, cumulative values may calculated and the cumulative values may be overwritten in the volatile memory MV every several frames using the values of pixel signals for the frames.

Also, although in the Embodiments 1 and 2, the case has been described in which a cumulative value is calculated for each display pixel, cumulative values may be calculated for each block including a plurality of display pixels.

(3) Although in the Embodiments 1 and 2, description has been provided using an example of a stress value of the organic EL element as the value corresponding to a cumulative value of a pixel signal, the present disclosure is not limited to this. A stress value of the drive transistor may be used. Alternatively, a configuration may be adopted in which both the stress value of the organic EL element and the stress value of the drive transistor are utilized.

So far, the embodiments have been described as the illustrative examples of the technique in the present disclosure. For this sake, the accompanying drawings and detailed description have been provided.

Therefore, the components described in the accompanying drawings and detailed description may include not only required components for solving the problem, but also not required components for solving the problem in order to illustrate the aforementioned technique. Therefore, it should be understood that those not required components are never determined to be required simply because those not required components are described in the accompanying drawings and detailed description.

Also, since the above-described embodiments are provided for the purpose of illustrating the technique in the present disclosure, various modifications, replacements, additions, omissions may be made in the claims and its equivalent range.

INDUSTRIAL APPLICABILITY

The present disclosure is applicable to a display device that includes a plurality of memories having different write speeds, and that performs processing utilizing cumulative values. Specifically, the present disclosure is applicable to an organic EL display, a plasma display, or a liquid crystal display.

The invention claimed is:

1. A method for correcting a display device including:

a display panel having display pixels, a first memory that stores cumulative values of pixel signals included in a video signal, a second memory having a slower write speed than a write speed of the first memory, and a control unit that controls display of the display panel, the method to be performed by the control unit, comprising:

performing cumulative processing for calculating the cumulative values repeatedly in every first period and storing the cumulative values in the first memory in every the first period;

performing transfer processing for transferring the cumulative values from the first memory to the second memory in every second period longer than the first period;

delaying timing of the transfer processing in one part of the display pixels from timing of the transfer processing in the other part of the display pixels according to the write speed of the second memory;

for each of the display pixels, reading a cumulative value from the first memory and correcting a corresponding pixel signal; and delaying start timing of the cumulative processing in the one part of the display pixels according to the timing of the transfer processing.

2. A method for correcting a display device including:

a display panel having display pixels, a first memory that stores cumulative values of pixel signals included in a video signal, a second memory having a slower write speed than a write speed of the first memory, and a control unit that controls display of the display panel, the method to be performed by the control unit, comprising:

performing cumulative processing for calculating the cumulative values repeatedly in every first period and storing the cumulative values in the first memory in every the first period;

performing transfer processing for transferring the cumulative values from the first memory to the second memory in every second period longer than the first period;

delaying timing of the transfer processing in one part of the display pixels from timing of the transfer processing in the other part of the display pixels according to the write speed of the second memory;

for each of the display pixels, reading a cumulative value from the first memory and correcting a corresponding pixel signal; and switching an order of transfer of the cumulative values in the transfer processing between a predetermined first order and a second order which is a reverse order of the first order, at timing when an initial value of the first memory is set using a value of the second memory.

3. The method for correcting a display device according to claim 1, wherein the display pixels include of organic EL elements, and the cumulative values include cumulative values corresponding to currents flowing through the organic EL elements, the currents being obtained from the pixel signals.

4. The method for correcting a display device according to claim 1, wherein the display pixels include thin film transistors, and the cumulative values include cumulative values corresponding to voltages applied to the thin film transistors, the voltages being obtained from the pixel signals.

5. The method for correcting a display device according to claim 1, wherein the cumulative processing is performed synchronously with write processing to the display pixels.

6. A correction device for a display device including:

a display panel having display pixels, a first memory that stores cumulative values of pixel signals included in a video signal, a second memory having a slower write speed than a write speed of the first memory, and a control unit that controls display of the display panel, the correction device to be performed in the display device, comprising the control unit configured to:

perform cumulative processing for calculating the cumulative values repeatedly in every first period and storing the cumulative values in the first memory in every the first period;

perform transfer processing for transferring the cumulative values from the first memory to the second memory in every second period longer than the first period;

delay timing of the transfer processing in one part of the display pixels from timing of the transfer processing in the other part of the display pixels according to the write speed of the second memory;

for each of the display pixels, read a cumulative value from the first memory and correcting a corresponding pixel signal; and delay start timing of the cumulative processing in the one part of the display pixels according to the timing of the transfer processing.

7. A correction device for a display device including:

a display panel having display pixels, a first memory that stores cumulative values of pixel signals included in a video signal, a second memory having a slower write speed than a write speed of the first memory, and a control unit that controls display of the display panel, the correction device to be performed in the display device, comprising the control unit configured to:

perform cumulative processing for calculating the cumulative values repeatedly in every first period and storing the cumulative values in the first memory in every the first period;

perform transfer processing for transferring the cumulative values from the first memory to the second memory in every second period longer than the first period;

delay timing of the transfer processing in one part of the display pixels from timing of the transfer processing in the other part of the display pixels according to the write speed of the second memory;

for each of the display pixels, read a cumulative value from the first memory and correcting a corresponding pixel signal; and switch an order of transfer of the cumulative values in the transfer processing between a predetermined first order and a second order which is a reverse order of the first order, at timing when an initial value of the first memory is set using a value of the second memory.

8. The correction device for a display device according to claim 6, wherein the first memory is a volatile memory, and the second memory is a non-volatile memory.

9. The correction device for a display device according to claim 6, wherein the display pixels are formed with a light emitting element.

* * * * *